US006408159B2

(12) United States Patent
Ishizuka et al.

(10) Patent No.: US 6,408,159 B2
(45) Date of Patent: Jun. 18, 2002

(54) FIXING APPARATUS CAPABLE OF HEATING THE RELEASING AGENT

(75) Inventors: Jiro Ishizuka, Numazu; Hirokazu Kodama, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/761,783

(22) Filed: Jan. 18, 2001

(30) Foreign Application Priority Data

Jan. 19, 2000 (JP) ..... 2000-010399
Feb. 4, 2000 (JP) ..... 2000-027134

(51) Int. Cl.[7] ..... G03G 15/20

(52) U.S. Cl. ..... 399/325; 118/DIG. 1; 219/216; 399/67

(58) Field of Search ..... 399/324, 325, 399/320, 328, 67, 69; 219/216; 118/DIG. 1

(56) References Cited

U.S. PATENT DOCUMENTS 5,563,695 A 10/1996 Sakurai et al. ..... 399/327
5,697,036 A * 12/1997 Moser ..... 399/329
5,729,818 A 3/1998 Ishizuka et al. ..... 399/400
5,903,799 A 5/1999 Saito et al. ..... 399/69
5,966,578 A 10/1999 Soutome et al. ..... 399/333
6,272,307 B1 * 8/2001 Ishizuka et al. ..... 399/325

FOREIGN PATENT DOCUMENTS

JP 58-200266 * 11/1983
JP 07-295422 * 11/1995
JP 09-244454 * 9/1997
JP 2000-122456 * 4/2000
JP 2001-42698 * 2/2001

* cited by examiner

*Primary Examiner*—Sophia S. Chen
(74) *Attorney, Agent, or Firm*—Fitzpatrick, Cella, Harper & Scinto

(57) ABSTRACT

The present invention provides a fixing apparatus that as a fixing member for fixing an unfixed image on a recording material, a containing portion for containing releasing agent, applying device for applying the releasing agent in the containing portion on the fixing member, heating device for heating the releasing agent in the containing portion, and detection device for detecting a temperature of the releasing agent in the containing portion, wherein heating by the heating device is controlled according to a detected temperature from the detection device.

8 Claims, 13 Drawing Sheets

FIXING APPARATUS CAPABLE OF HEATING THE RELEASING AGENT

BACKGROUND OF THE INVENTION

1. Field of the Invention

The present invention relates to a fixing apparatus applicable to an image forming apparatus such as a copying machine or a printer, and more particularly to an apparatus for coating a fixing member with a releasing agent.

2. Related Background Art

As an example of such image forming apparatus, there is conventionally known an apparatus equipped with a fixing apparatus 150 as shown in FIG. 12.

As detailedly shown in FIG. 12, the fixing apparatus 150 is provided with a fixing roller 151 constituting a rotatably provided fixing member, a pressure roller 152 constituting another fixing member (pressurizing member) rotated in pressurized contact with the fixing roller 151, a releasing agent applying (coating) apparatus 153, and roller cleaning apparatuses 154, 155. The fixing roller 151 and the pressure roller 152 are respectively provided therein with heaters 156, 157 constituting heating means an composed for example of halogen lamps. Thermistors 158, 159 are so positioned as to be respectively in contact with the fixing roller 151 and the pressure roller 152 and control the voltages supplied to the heaters 156, 157 through temperature adjusting circuits thereby executing adjustment of the surface temperature of the fixing roller 151 and the pressure roller 152.

On the fixing roller 151 there are mounted the cleaning apparatus 154 and the releasing agent coating apparatus 153. The cleaning apparatus 154 cleans the fixing roller 151 by removing the toner etc. deposited thereon by offsetting, and the releasing agent coating apparatus 153 coats a releasing agent such as silicone oil onto the fixing roller 151 thereby facilitating the separation of a transfer paper P, constituting the recording material, from the fixing roller 151 and prevents the toner deposition by offsetting.

The cleaning apparatus 154 is composed of a cleaning web 154*a* consisting of a heat-resistant web-shaped non-woven cloth, a pressure roller 154*b* for pressing the cleaning web 154*a* to the fixing roller 151, an unwinding roller 154*c* for feeding the new cleaning web 154*a*, and a winding roller 154*d* for gradually winding the cleaning web 154*a* which is deteriorated in the cleaning ability for example by deposition of toner. The cleaning apparatus 154 is provided upstream of the thermistor 158 in the rotating direction of the fixing roller 151, in order to protect the thermistor 158 from detection error resulting from the sticking thereto of the offset toner.

When a predetermined number of copying operations is judged by a counter, a solenoid (not shown) is energized to activate a one-way clutch to wind the cleaning web 154*a* by a predetermined amount, in a direction opposite to the rotating direction of the roller. Such winding in the opposite direction avoids dragging of the cleaning web 154*a* in the rotating direction of the roller.

The releasing agent coating apparatus 153 is composed of an oil tank 153*a* or a releasing agent container for containing the releasing agent such as silicone oil, and a coating roller 153*d* constituting releasing agent supply means which bears the releasing agent on oil, picked up by pickup rollers 153*b*, 153*c* from the oil tank 153*a*, for supply onto the surface of the fixing roller 151, and a regulating blade 153*e* consisting of an elastic member is so provided as to abut on the coating roller 153*d* for maintaining a constant oil amount thereon, thereby attaining uniform oil coating onto the fixing roller 151. The releasing agent coating apparatus 153 is positioned downstream of the thermistor 158 in the rotating direction of the fixing roller 151.

Also the pressure roller 152 is provided with a cleaning apparatus 155 composed, similarly to the cleaning apparatus 154, of a cleaning web 155*a*, a pressure roller 155*b*, an unwinding roller 155*c* and a winding roller 155*d*, in order to remove the toner on the pressure roller 152 transferred from the fixing roller 151.

On the pressure roller 152, there abuts an oil removing blade 160 consisting of an elastic member for removing the excessive releasing agent remaining on the pressure roller 152. Without such oil removing blade 160, the excessive releasing agent is accumulated in the nip of the fixing roller 151 and the pressure roller 152, eventually causing a stain on the recording material or failure in the entry into the nip in certain recording material such as a transparent laminate OHP film. The oil removing blade 160 is composed for example of silicone rubber or fluorinated rubber, and abuts on the pressure roller 152 with an appropriate amount of intrusion in the opposite (or forward) direction with respect to the rotating direction of the pressure roller 152.

When a transfer paper P is conveyed in such configuration, the fixing roller 151 and the pressure roller 152 are rotated and silicone oil as the releasing agent is coated on the surface of the fixing roller 151. Thus, while passing between the fixing roller 151 and the pressure roller 152, the transfer paper P is pressed and heated by substantially constant pressure and temperature from both surfaces, whereby the unfixed toner image on the paper is fused and fixed to form a full-color image thereon. The transfer paper P bearing the fixed image is separated by an under separation claw 168 from the pressure roller 152 and is discharged from the apparatus.

However, such conventional image forming apparatus has been associated with the following drawbacks.

Firstly, the heat fixing apparatus in the ordinary copying machine waits for a predetermined period, after the power supply is turned on, until the fixing roller reaches a predetermined temperature, and the copying operation is enabled after such predetermined temperature is reached. However the fixing ability is different between immediately after the copying operation is enabled ("first run in the morning") and after the lapse of a certain time in the copy-enabled stand-by state ("standing state"). Such phenomenon arises from the difference, between the first run in the morning and the standing state, not only in the surface temperature of the fixing roller but also the temperature of the entire fixing apparatus and that of the releasing agent to be coated on the surface of the fixing roller.

More specifically, in the standing state, the heat of the fixing roller is transferred to the releasing agent through the coating roller and the pickup rollers thereby elevating the temperature of the releasing agent. In such state, the temperature loss of the fixing roller is limited when the releasing agent is coated thereon, and the releasing agent present between the fixing roller and the toner is also heated, whereby satisfactory fixing ability is secured. On the other hand, in the first run in the morning, the releasing agent is still cold and the fixing roller shows an abrupt temperature loss when such releasing agent is coated thereon, and the releasing agent of a low temperature is present between the fixing roller and the toner, whereby the fixing ability is deteriorated. Such phenomenon becomes more conspicuous in an environment of low temperature.

In order to avoid such drawback, the present applicant already proposed a fixing apparatus, provided, as shown in FIG. 13, with a releasing agent heating member 180 composed of a heat generating member or a heater 182, a heat conductive member 181 composed for example of a metal, a temperature of the heater 182, a safety element 184 for preventing excessive temperature of the heater 182 etc., setting to heat the releasing agent in the oil tank 153*a*.

In such fixing apparatus, the temperature detecting element 183 detects the temperature of the heater 182, and, if the detected temperature is lower than a desired temperature, the heater 182 of the releasing agent heating member 180 is powered to elevate the temperature of the heater 182. The heat of the heater 182 is transmitted through the heat conducting member 181 to elevate the temperature of the releasing agent. When the heater 182 reaches the desired temperature, the electric power supply thereto is cut off whereby the temperature of the releasing agent is no longer elevated.

In such configuration, however, the releasing agent may not reach an appropriate temperature, since the power supply to the heater 182 is controlled by the temperature detecting element 183 for detecting the temperature of the heater 182.

SUMMARY OF THE INVENTION

An object of the present invention is to provide a fixing apparatus capable of heating the releasing agent to an appropriate temperature.

Another object of the present invention is to provide a fixing apparatus capable of preventing excessive heating of the releasing agent, thereby achieving satisfactory fixation.

Still another object of the present invention is to provide a fixing apparatus comprising a fixing member for fixing an unfixed image onto a recording material, a containing portion for containing a releasing agent, applying means for applying the releasing agent in the containing portion on the fixing member, heating means for heating the releasing agent in the containing portion, and detection means for detecting a temperature of the releasing agent in the containing portion, wherein heating of the heating means is controlled based on a detected temperature from the detection means.

Still another object of the present invention is to provide a fixing apparatus comprising a fixing member for fixing an unfixed image onto a recording material, a containing portion for containing a releasing agent, applying means for applying the releasing agent in the containing portion on the fixing member, heating means for heating the releasing agent in the containing portion, first detection means for detecting a temperature of the releasing agent in the containing portion, and second detection means for detecting a temperature of the temperature of the heating means, wherein heating of the heating means is controlled based on detected temperature from the first detection means and the second detection means.

Still other objects of the present invention, and the features thereof, will become fully apparent from the following description.

DETAILED DESCRIPTION OF THE PREFERRED EMBODIMENTS

In the following, the present invention will be clarified in detailed by embodiments thereof, with reference to the accompanying drawings.

Figure 1:
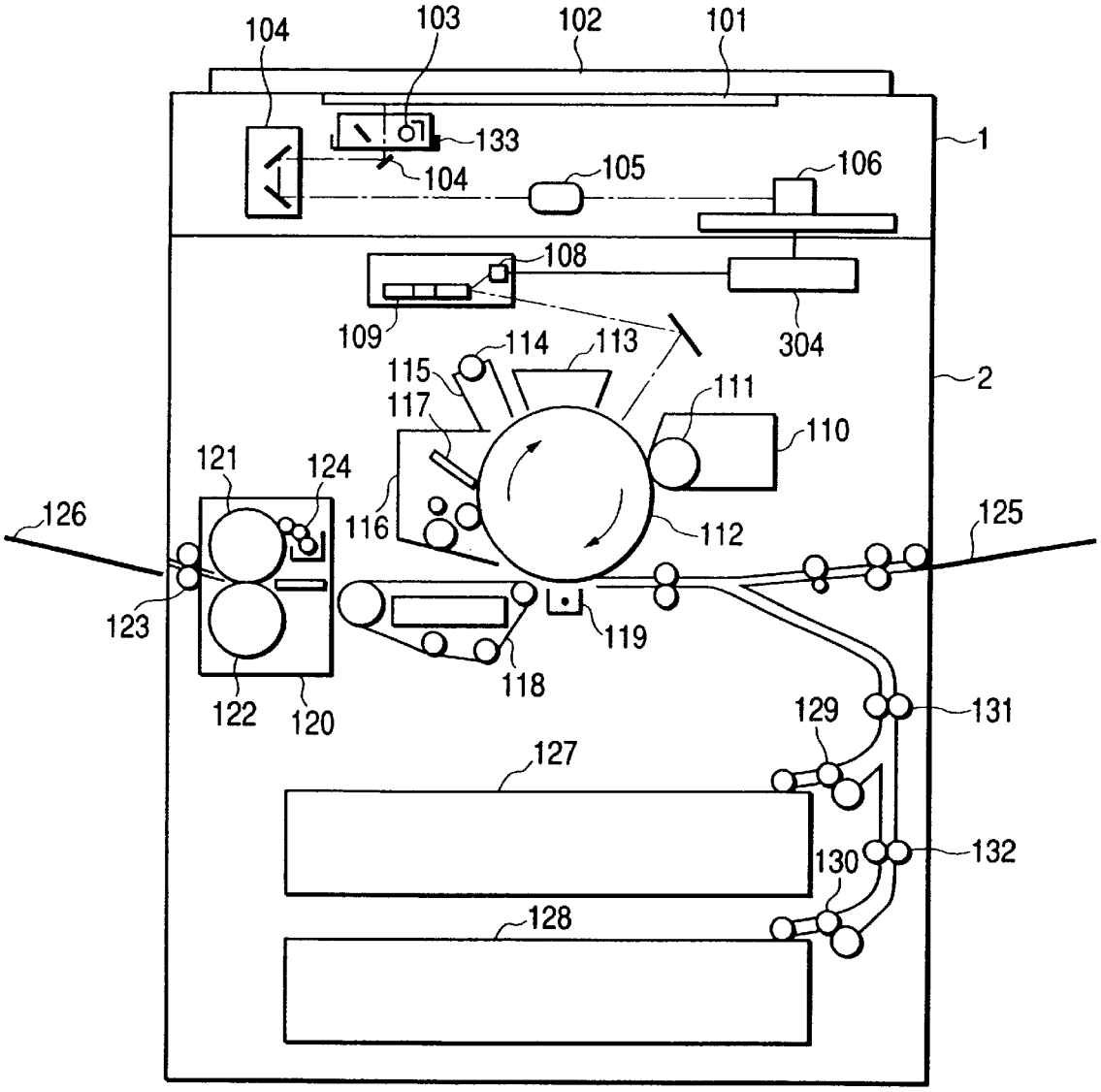
FIG. 1 is a view showing an image forming apparatus employing a fixing apparatus according to an embodiment of the present invention.

FIG. 1 is a schematic cross-sectional view showing the configuration of a digital image forming apparatus as an example of the image forming apparatus of the present invention.

At first there will be explained, with reference to FIG. 1, the configuration and function of such image forming apparatus.

The image forming apparatus is provided, as shown in FIG. 1, with a reader portion 1 and a printer portion 2 respectively in the upper and lower parts of the main body of the apparatus.

The reader portion 1 is composed of an original supporting glass 101 on which an original is to be placed, an original pressure plate 102 for pressing the placed original from above, a mirror support 133 bearing a light source 103 and scanning the original, plural mirrors 104 and a lens 105 for guiding the light reflected from the original, and a photoelectric conversion/image processing portion 106 for photoelectrically converting the light reflected from the original by means of a CCD 301 and applying various image processings on the obtained electrical signal. The photoelectric conversion/image processing portion 106 is also provided with image processing functions for executing A/D conversion, shading correction, masking correction, variation of magnification, mG conversion etc. on the photoelectrically converted electrical signal.

The reader portion 1 of the above-described configuration functions in the following manner.

In the reader portion 1, an original is placed, with the image bearing surface thereof downwards, on the original supporting glass 101 and is pressed thereon by the original pressure plate 102. The mirror support 133 moves with the light source 103 turned on, thereby scanning the image bearing surface of the original. The light reflected from the image bearing surface is guided by the plural mirrors 104 and the lens 105 and is focused on the CCD 301 of the photoelectric conversion/image processing portion 106, thereby being photoelectrically converted into an electrical signal. The electrical signal constituting the image signal is transmitted, after being subjected to various image processings, to the printer portion 2.

The printer portion 2 is principally provided, as shown in FIG. 1, with an image forming portion including a photosensitive drum 112, a laser control portion 304 for converting the image signal, transmitted from the reader portion 1, into a signal for driving a laser, a laser element 108, a polygon scanner 109 for scanning the surface of the photosensitive drum 112 with a laser light, and a fixing unit 120 constituting the fixing apparatus.

The above-mentioned image forming portion is provided with a photosensitive drum 112 supported rotatably in a direction indicated by an arrow, and, along the periphery thereof and in the order along the rotating direction thereof, with a primary charger 113 for uniformly charging the surface of the photosensitive drum 112, a developing unit 110 for developing an electrostatic latent image formed on the photosensitive drum 112, a transfer charger 119 for transferring the toner image from the photosensitive drum 112 onto a transfer material or a recording material, a cleaner 116, a cleaning blade 117 for removing the toner remaining on the photosensitive drum 112, an auxiliary charger 115 for eliminating the charge on the surface of the photosensitive drum 112, and a pre-exposure lamp 114 for removing the charge remaining on the surface of the photosensitive drum 112.

The developing unit 110 is further provided with a developing roller 111, which rotates in a direction opposite to that of the photosensitive drum 112, thereby executing development of the toner image on the photosensitive drum 112.

The transfer material bearing the transferred toner image is conveyed by a pre-fixing belt 118 to a fixing unit 120 constituting the fixing apparatus, and is conveyed therein by being pinched between a fixing roller 121 constituting a fixing member and a pressure roller 122 constituting another fixing member (pressurizing roller) which are rotated in mutual contact and is subjected to heat and pressure whereby the toner image on the surface is fixed. The transfer material after image fixing is discharged by conveying rollers 123 onto a sheet discharge tray 126 positioned outside the main body of the apparatus.

A feed/conveying portion for feeding the transfer material is provided with a conveying path for the transfer material, and, at the most upstream side in the conveying direction, with a sheet feeding apparatus including sheet cassettes 127, 128, feed rollers 129, 130, conveying rollers 131, 132 etc.

In addition to the sheet feeding apparatus, there is provided a multi sheet feeding apparatus 125 which, having a straight sheet feeding path, is capable of feeding various transfer materials different in the material and the size to the image forming portion.

Figure 2:
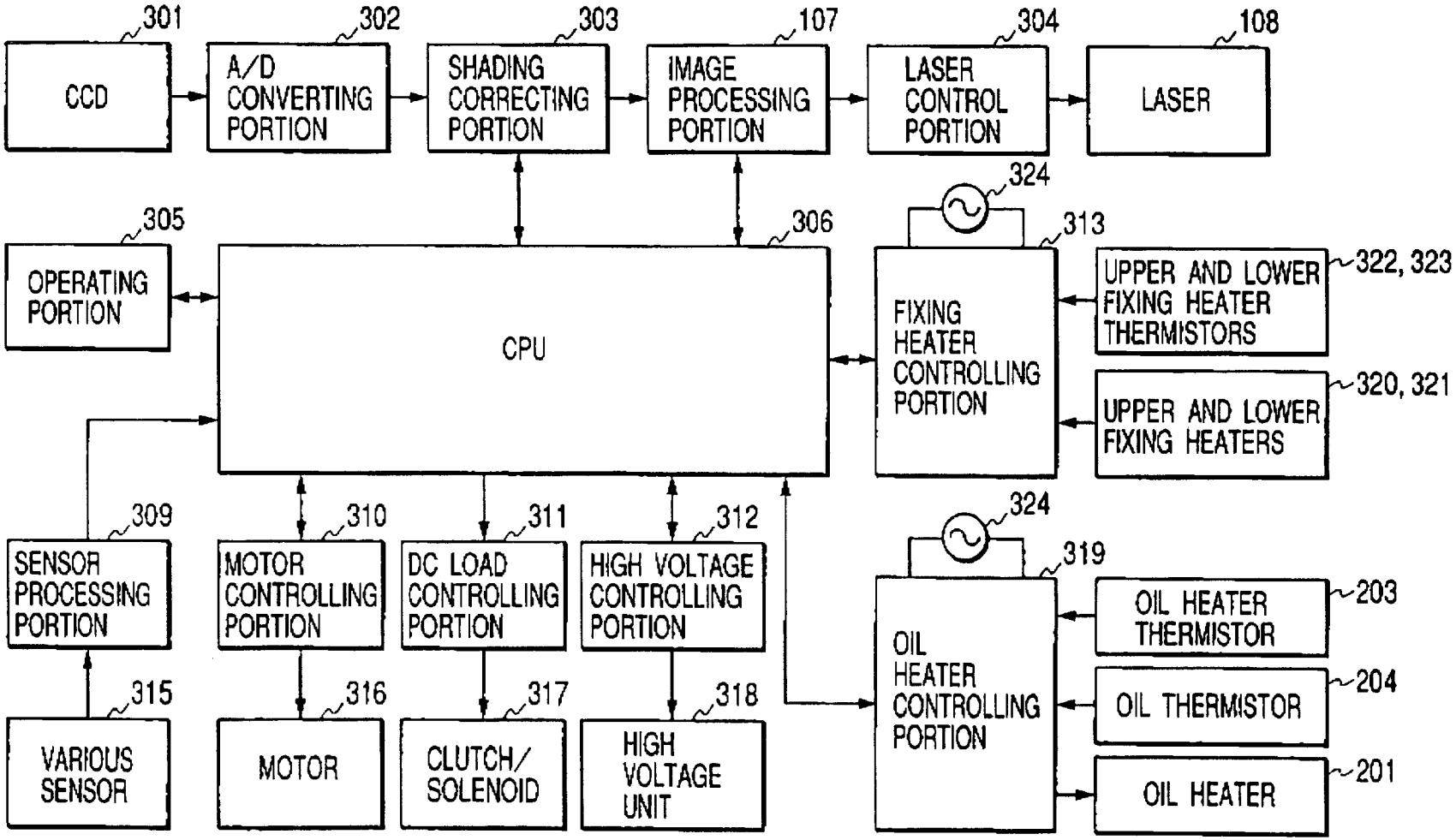
FIG. 2 is a block diagram of a control system of the image forming apparatus.

In the following there will be explained, with reference to FIG. 2, a control system of the image forming apparatus of the present embodiment.

The image forming apparatus of the present embodiment is comprehensively controlled by a CPU 306. The CPU 306 principally serves to drive various loads in the apparatus, collect and analyze the information of the sensors, and exchange data with the aforementioned image processing portion 107, laser control portion 304 and an operation portion 305 constituting the user interface. The CPU 306 is also connected to a ROM (not shown) storing programs for executing various sequences relating to the aforementioned image forming sequence, and a RAM for storing rewritable data which have to be stored temporarily or permanently. The above-mentioned RAM stores, for example, a high voltage value to be set in a high voltage control portion 312 to be explained later, various data to be explained later, an image forming command information from the operation portion 305.

At first there will be explained a first role of the CPU 306, namely data exchange with the shading correcting portion 303, the image processing portion 107, the laser control portion 304 and the operation portion 305.

The original image photoelectrically converted by the CCD 301 is converted by the succeeding A/D conversion portion 302 into digital image data and entered into the shading correction portion 303. The shading correction portion 303 is controlled by the CPU 306 and executes black level offset adjustment and white level shading correction including the characteristics of the light source 103 on the entered image data. The image data after the shading correction are entered into the image processing portion 107 and are subjected to masking correction, variation of magnification, image repeating, image synthesis, and various decorative processes (screening, screen overlay, screen underlay, shadowing etc.).

The CPU 306 transmits set data for the various portions required for such processes, also receives signals from various portion such as an original image density signal, and executes setting for optimum image formation by controlling the high voltage control portion 312 and the laser control portion 304 to be explained later.

The laser control portion 304 controls the laser in the optimum manner, based on the image size defined for image formation and on the processed digital video data. Thus, in the present apparatus, there is executed setting required for PWM control of the laser light emission.

The operation portion 305 obtained the copying magnification, density value etc. set by the user, and outputs data for informing the user of the status of the image forming apparatus, for example the number of image formations, whether the image forming process is in progress, generation and location of the sheet jamming.

In the following there will be explained a second role which is to drive various loads of the apparatus and to collect and analyze information of the sensors.

The image forming apparatus of the present embodiment is provided, in various locations therein, with motors 316, DC loads 317 such as clutches/solenoids and sensors 315 such as photointerruptors and microswitches. The transfer material is conveyed and the various units are driven by suitably activating the motors 316 and the DC loads 317. These motions are monitored by the sensors 315. Based on the sensors 315, and sensor processing portion 309, the CPU 306 causes the motor control portion 310 to control the motors 316 and causes the DC load control portion 311 to activate the DC loads 317 such as clutches/solenoids thereby achieving smooth image forming operation. Also various high voltage control signals are supplied to the high voltage control portion 312 to feed appropriate high voltages to the primary charger 113, auxiliary charger 115, transfer charger 119 and developing roller 111 constituting the high voltage unit 318.

Also as a third role, the CPU 306 receives the output signal of a thermistor in the fixing unit 120 and controls fixing heaters 320, 321 and an oil heater 201 serving as the releasing agent heating body.

The fixing roller 121 and the pressurizing roller 122 in the aforementioned fixing unit 120 are respectively provided with fixing heaters 320, 321 for heating the rollers, and there is also provided an oil heater 201 for heating the oil constituting the releasing agent to be applied on the fixing roller 121 and the pressurizing roller 120.

The heaters (fixing heaters 320, 321, oil heater 201) are respectively on/off controlled by a fixing heater control portion 313 and an oil heater control portion 319 constituting the releasing agent temperature control means.

The fixing heater control portion 313 and the oil heater control portion 319 are connected to a primary power source 324 for supplying the heaters with the primary electric power, and the power supply is on/off controlled by triacs 606 in the fixing heater control portion 313 and the oil heater control portion 319.

Also, the fixing roller 121 and the pressurizing roller 122 are provided with fixing heater thermistors 322, 323 for measuring the surface temperature of the rollers, and the oil heater 201 is provided with an oil heater themistor 204 constituting the heating body temperature detection means for measuring the surface temperature. Based on the temperature data, the CPU 306 controls the aforementioned fixing heater control portion 313 and oil heater control portion 319.

Figure 3:
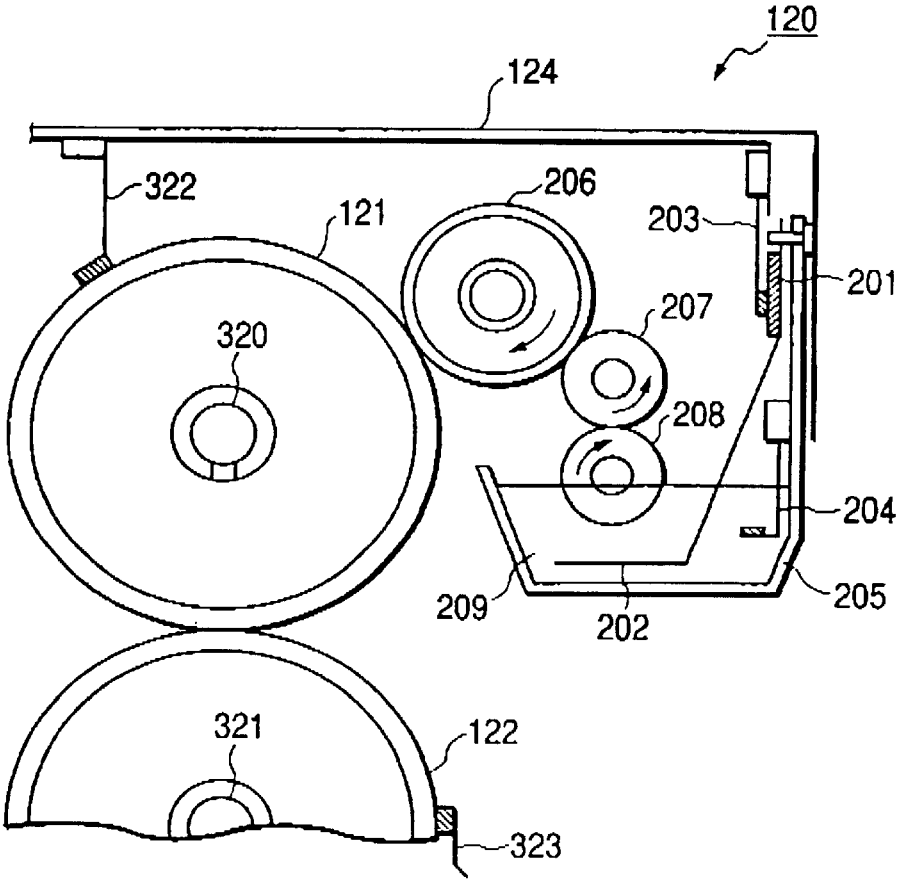
FIG. 3 is a view showing the fixing apparatus.

In the following there will be given a detailed explanation on the fixing unit 120, with reference to FIG. 3.

In the fixing unit 120, the fixing roller 121 and the pressurizing roller 122 are provided therein with fixing heaters 320, 321 serving to heat the rollers and generally composed of halogen heaters.

The fixing rollers 320, 321 are on/off controlled, as explained in the foregoing, by the CPU 306 through the fixing heater control portion 313.

Also the fixing heaters 320, 321 are on/off controlled so as to be maintained at a predetermined temperature, based on the temperatures measured by the fixing heater monitoring thermistors 322, 323 so positioned as to be in contact with the rollers.

The fixing unit 120 is furthermore provided with an oil coating unit 124 constituting a releasing agent applying (coating) apparatus for applying silicone oil for improving the releasing of the transfer material from the upper fixing roller 121.

The oil applying (coating) unit 124 is provided with an oil pan 205 for containing silicone oil (hereinafter simply called oil) 209, an oil heater 201 for regulating the oil temperature for maintaining constant temperature and viscosity in the oil, a heater metal plate 202 constituting a support member for mounting the oil heater 201 and indirectly transmitting the heat of the oil heater 201 to the silicone oil 209, an oil heater thermistor 203 for measuring the temperature of the oil heater 201, an oil thermistor 204 for measuring the temperature of the oil in the oil pan 205, and oil coating rollers 206, 207, 208 constituting the releasing agent supply means for coating an appropriate amount of oil onto the upper fixing roller 121.

The oil heater 201 is on/off controlled by the CPU 306 through the oil heater control portion 319.

In the present embodiment, as explained in the foregoing, the oil temperature is directly detected and the oil heater is on/off controlled in consideration of the detected temperature, so that the oil can be more effectively maintained at the appropriate temperature.

Figure 6:
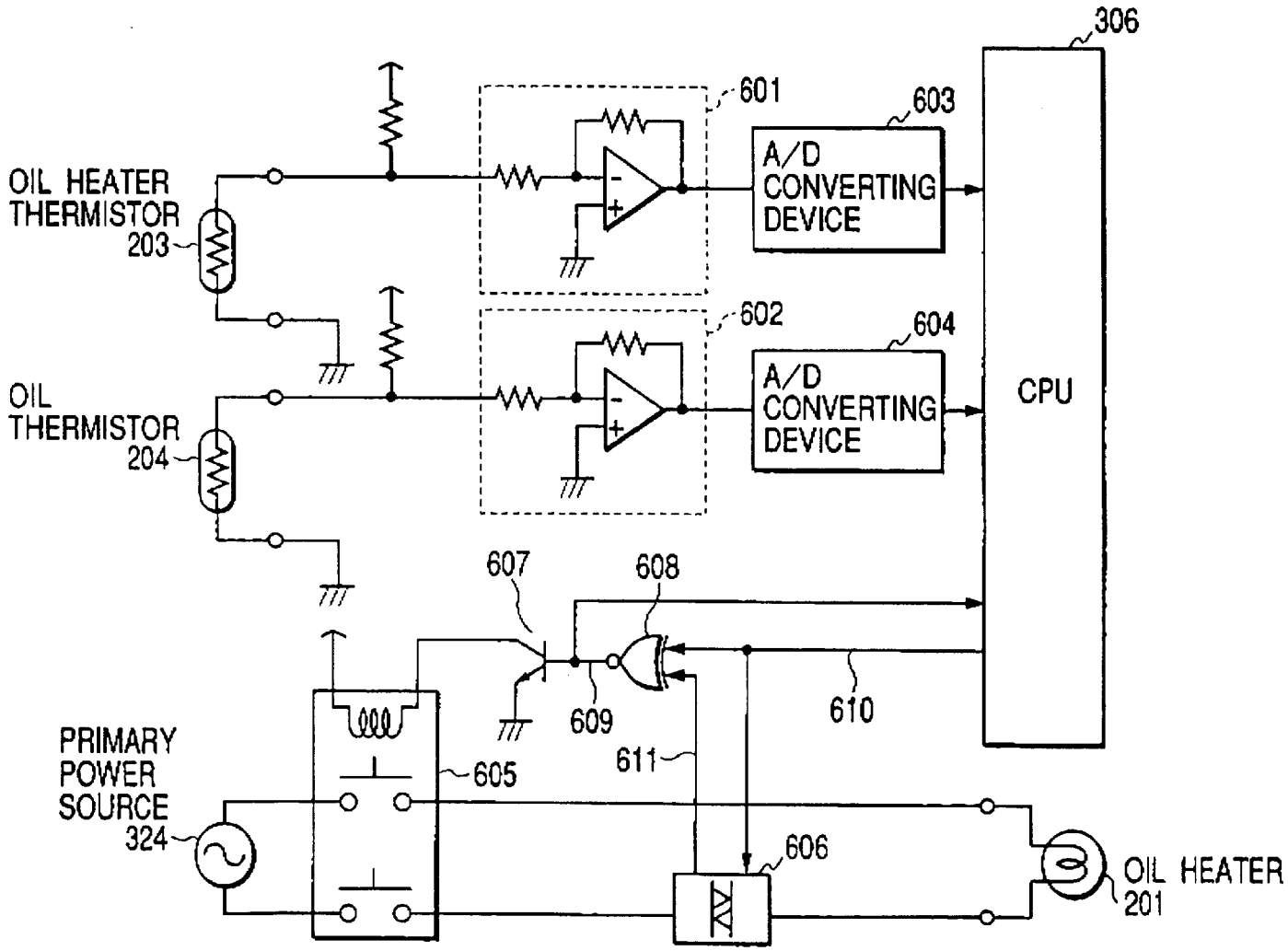
FIG. 6 is a block diagram of the releasing agent temperature control means.

FIG. 6 is a circuit diagram showing an embodiment of the oil heater control portion 319 of the present invention.

In the oil heater control portion 319, the output signals of the oil heater thermistor 203 and the oil thermistor 204 are respectively supplied to amplifying circuit 601, 602, and A/D converting portions 603, 604 convert the changes in the resistances of the thermistors, corresponding to the temperature changes in the oil heater 201 and the silicone oil 209, into voltages which are respectively supplied, as digital data, into the CPU 306. Based on such temperature data, the CPU 306 outputs an oil control signal for on/off controlling the oil heater 201 to be explained later.

The oil heater control portion 319 is connected to the primary power source 324 for supplying the oil heater 201 with the primary electric power, of which supply is on/off controlled by the triac 606 according to the oil control signal 610 from the CPU 306.

The triac 606 is provided therein with an abnormality detection circuit, which outputs an abnormality detection signal 611 to an EX-OR circuit in case of a shortcircuiting of the triac.

Upon receiving the abnormality detection signal 611 (logic H) while the oil control signal 610 is turned off (logic L), the EX-OR circuit 608 shifts the output thereof to a level L thereby outputting an abnormality signal 609 to the CPU 306 and at the same time turns off a transistor 607, thereby forcedly interrupting the supply of the primary electric power to the oil heater 201 by a relay 605.

Also based on the signals from the oil heater thermistor 203 and the oil thermistor 204, the oil heater control portion 319 executes abnormality detection, such as detection of the abnormal output from the thermistors in case the detachment or breakage thereof, and outputs an abnormality signal to the CPU 306 and at the same time forcedly turns of the power supply to the oil heater 201.

The oil thermistor is provided separately from the heater plate in order to avoid influence from the oil heater, and, for this reason, the oil temperature detected by the oil thermistor may be different from that in the vicinity of the heater plate. Therefore, there may result a drawback that the oil temperature detected by the oil thermistor may be judged low and the oil of high temperature in the vicinity of the heater plate may be excessively heated.

The present embodiment is also to avoid the above-described drawback. In the following there will be explained, with reference to FIGS. 4A, 4B and 5, the function of the oil heater control portion 319 in the image forming apparatus of the present embodiment.

Figure 4A:
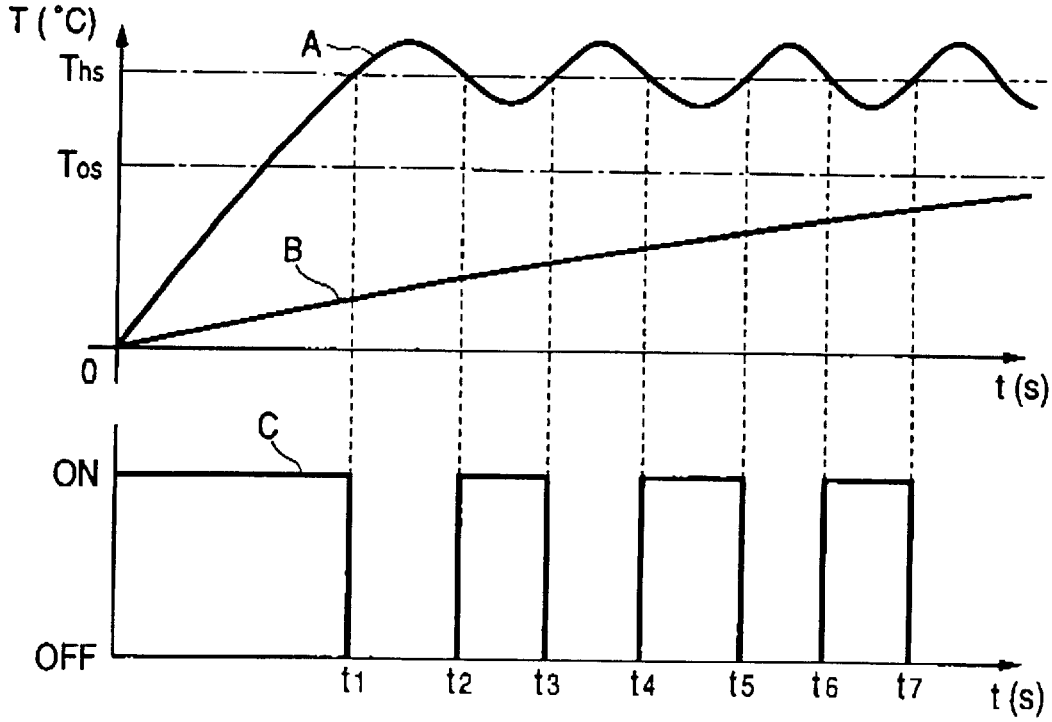
FIGS. 4A and 4B are charts showing the relationship between the detected temperature of the releasing agent temperature detecting means and the heating body temperature detecting means, and the drive timing of the releasing agent heating body by the releasing agent temperature control means.
Figure 4B:
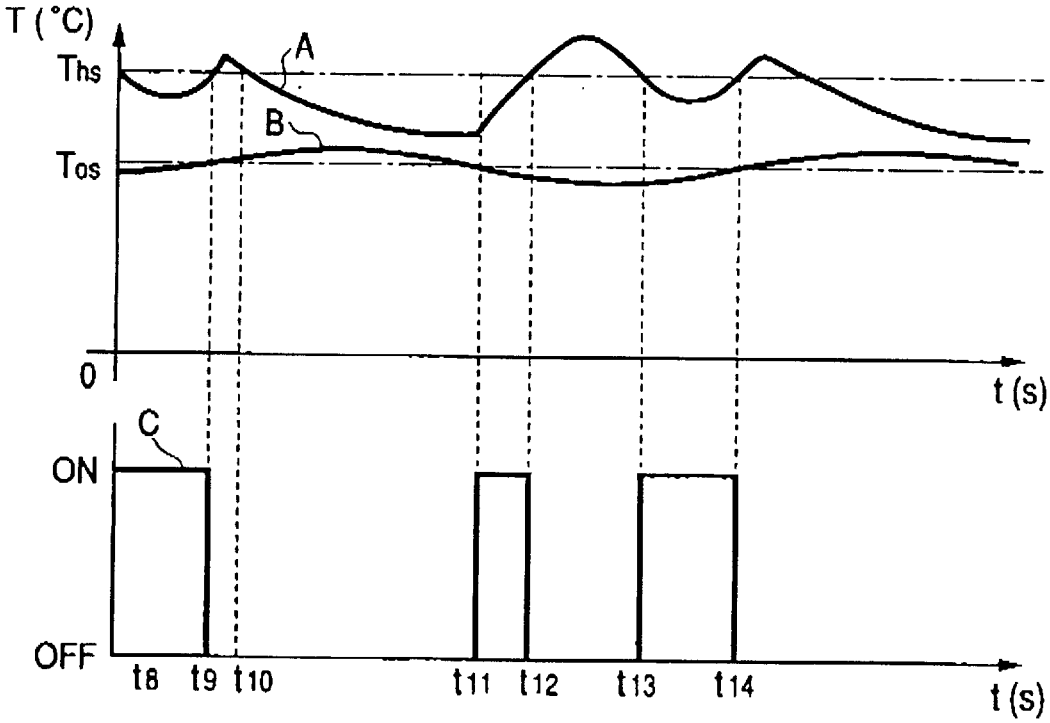

FIGS. 4A and 4B are charts showing the oil temperature control function of the oil heater control portion 319 of the present embodiment. In FIGS. 4A and 4B, upper lines A indicate the temperature of the oil heater 201 measured by the oil heater thermistor 203, while lines B indicate the oil temperature measured by the oil thermistor 204. Also lower lines C indicate an oil control signal 610 supplied from the oil heater control portion 319 to the oil heater 201.

When the oil heater control portion 319 at first drives the oil heater 201, the oil temperature (line B) rises more gradually than the oil heater temperature (line A) as shown in FIGS. 4A and 4B. This is because the entire system including the heater, silicone oil, heater plate 202 etc. has a large heat capacity.

When the oil temperature B does not exceed a predetermined oil temperature (hereinafter called set oil temperature) Tos, there is executed the temperature control based on the temperature signal from the oil heater thermistor 203 to on/off control the oil heater 201 as indicated by times t1 to t7 in FIG. 4A, thereby bringing the oil heater temperature A to a predetermined heater temperature (hereinafter called set heater temperature) Ths.

When the oil temperature B gradually rises and exceeds the set oil temperature Tos as shown at a time t9 in FIG. 4B, the oil heater 201 is turned off and remains turned off even after the oil heater temperature A becomes equal to or lower than the set heater temperature Ths (time t10). Then, when the oil temperature B becomes equal to or lower than the set oil temperature Tos, the oil heater 201 is on/off controlled so as to maintain the oil heater temperature A at the set heater temperature Ths (times t11 to t14).

Figure 5:
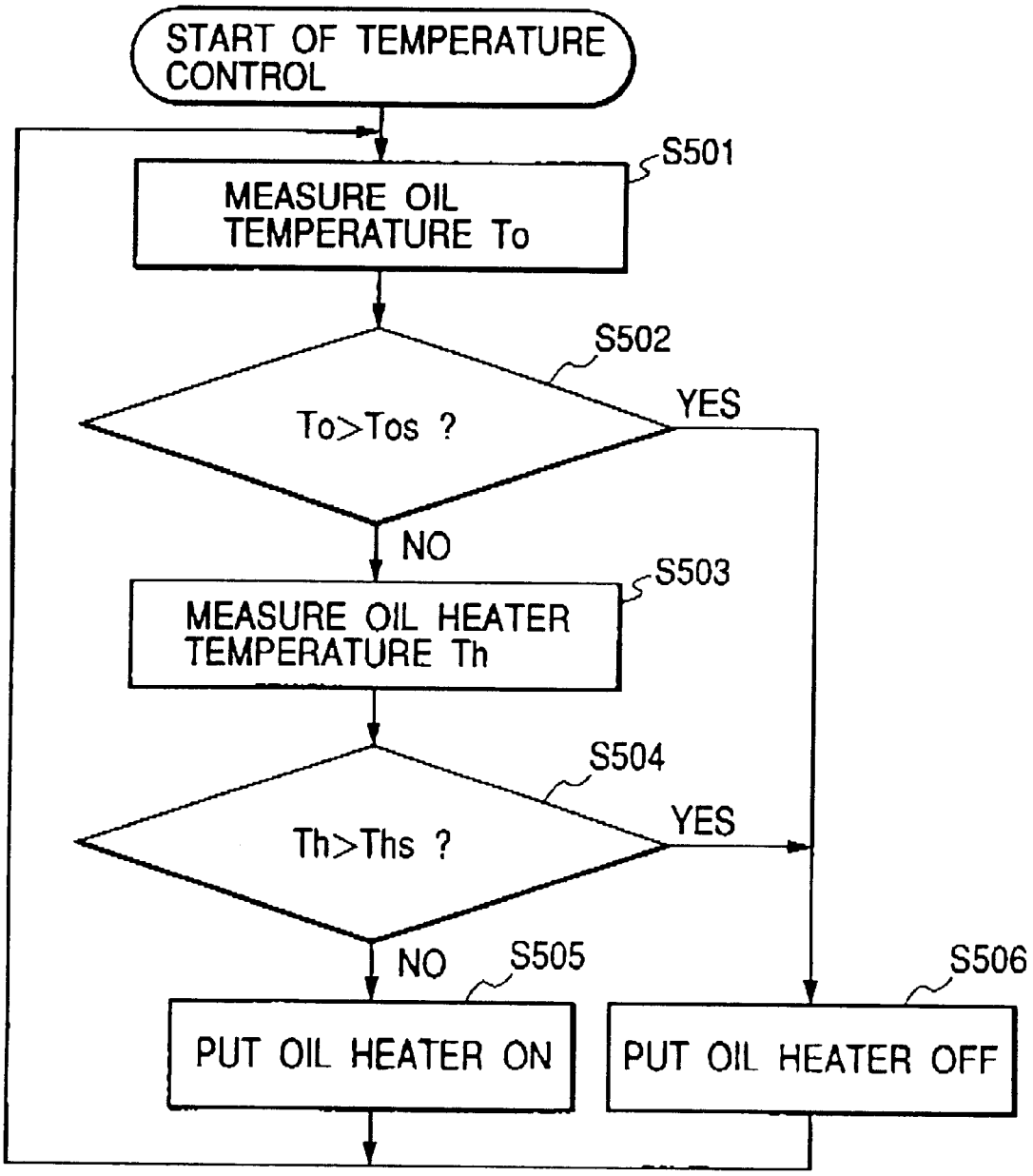
FIG. 5 is a flow chart showing the function of the releasing agent temperature control means.

FIG. 5 is a flow chart showing the sequence of oil temperature control by the oil heater control portion 319 of the present embodiment.

In the oil heater control portion 319, when the oil temperature control is started, there is at first measured the oil temperature To by the oil Thermistor 204 (S501).

In case the oil temperature To exceeds the predetermined set oil temperature Tos (S502), the oil heater is turned off (S506), but, in case the oil temperature To does not exceed the set oil temperature Tos, the oil heater temperature Th is measured (S503) in order to execute temperature control by driving the oil heater based on the temperature signal of the oil heater thermistor 203.

In case the oil heater temperature Th does not exceed the predetermined set heater temperature Ths (S504), the oil heater is driven (S505), but, if the oil heater temperature Th exceeds the set heater temperature Ths, the oil heater is turned off (S506).

The above-described temperature control sequence is repeated to execute the temperature control based on the temperature signal of the oil heater thermistor 203 in case the oil temperature To does not exceed the set oil temperature Tos and to turn off the oil heater in case the oil temperature To exceeds the set oil temperature Tos (S506), thereby maintaining the oil temperature To at the set oil temperature Tos.

Thus, the present embodiment allows to prevent excessive heating of oil, thereby preventing deterioration of the oil and achieving satisfactory image fixation.

Also the constantly maintained oil temperature allows to maintain a constant viscosity of the oil, thereby stabilizing the oil coating amount on the fixing roller and achieving uniformity in the luster etc. of the output image.

In the following there will be explained another embodiment of the present invention, with reference to the accompanying drawings.

Figure 7:
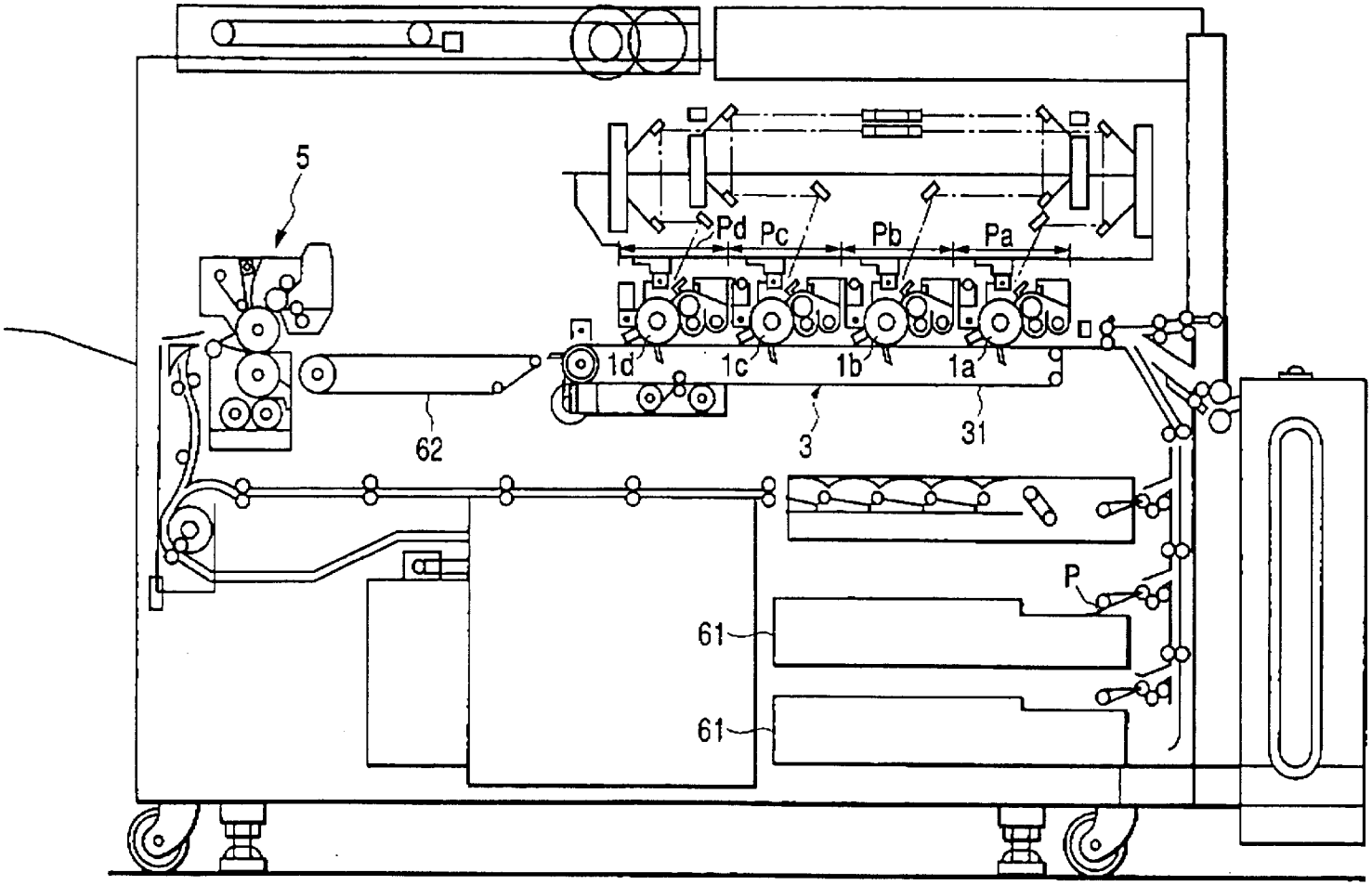
FIG. 7 is a view showing an image forming apparatus employing a fixing apparatus according to another embodiment of the present invention.
Figure 8:
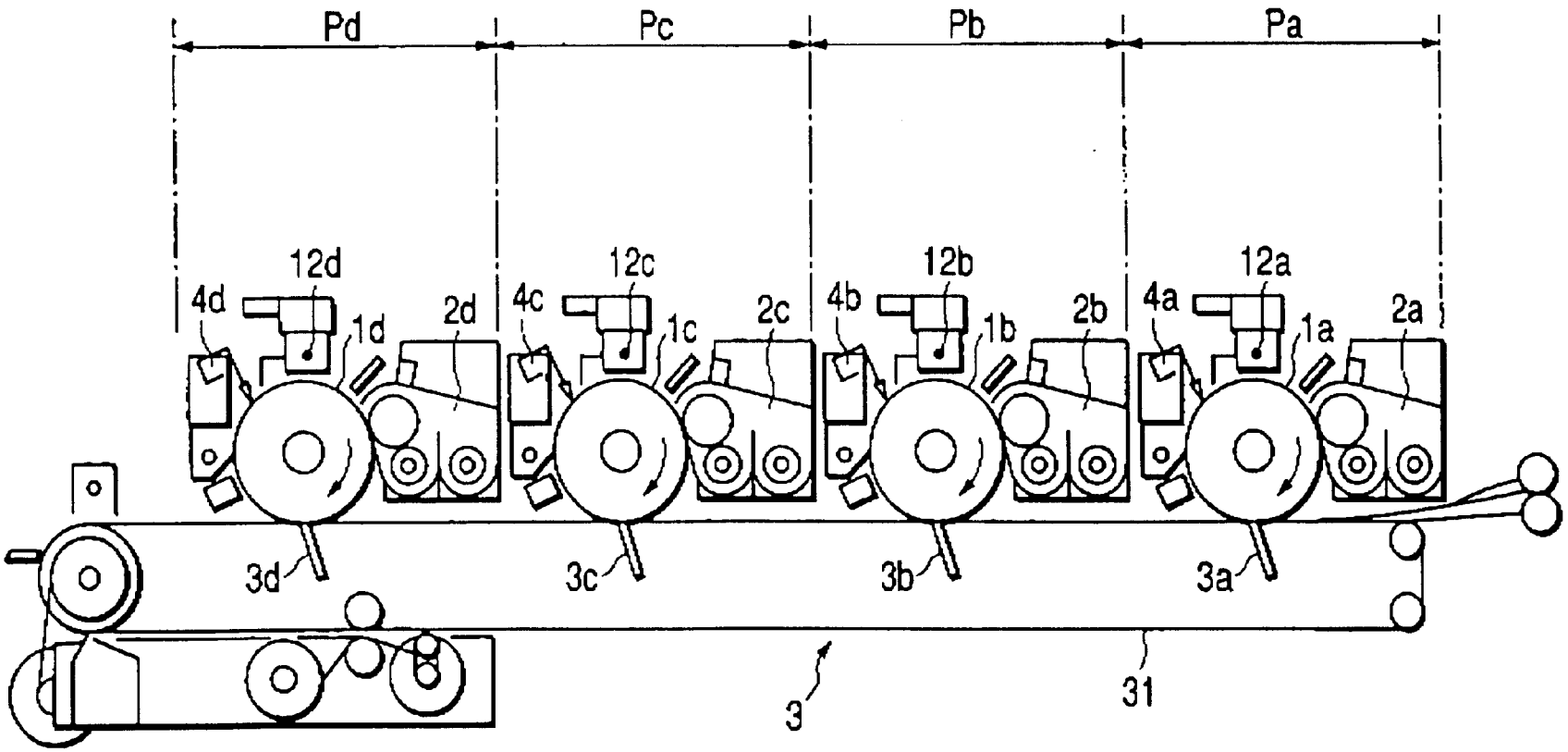
FIG. 8 is a view showing an image forming portion.

As an example of the image forming apparatus embodying the present invention, there will be explained a 4-drum laser beam printer (hereinafter simply called printer) provided with plural optical scanning means as shown in FIGS. 7 and 8.

FIG. 7 is a schematic cross-sectional view showing the configuration of such printer, and FIG. 8 is a magnified cross-sectional view of an image forming portion of the apparatus shown in FIG. 7.

As shown in FIG. 7, such printer is provided with four image forming stations constituting image forming means, each having a developing apparatus etc. around an electrophotographic photosensitive body (hereinafter called photosensitive drum) constituting a latent image bearing member, and images formed on the photosensitive drums of the respective image forming stations are transferred onto a recording material such as paper (hereinafter simply called paper) conveyed in contact with the photosensitive drums.

Also as shown in FIG. 8, the image forming stations Pa, Pb, Pc, Pd for respectively forming color images of magenta, cyan, yellow and black are provided with photosensitive drums 1*a*, 1*b*, 1*c*, 1*d* which are rotated in a direction indicated by arrows.

Around the photosensitive drums 1*a*, 1*b*, 1*c*, 1*d*, there are respectively provided chargers 12*a*, 12*b*, 12*c*, 12*d*, developing apparatus 2*a*, 2*b*, 2*c*, 2*d* and cleaners 4*a*, 4*b*, 4*c*, 4*d* in succession along the rotating direction of the photosensitive drums, and, under the photosensitive drums, there is provided a transfer portion 3. The transfer portion 3 includes a transfer belt 31 which is common to the image forming stations and transfer chargers 3*a*, 3*b*, 3*c*, 3*d*.

In the above-described printer, a transfer paper P constituting the recording medium and supplied from a paper cassette 61 shown in FIG. 7 and constituting the recording material supply means is supported on the transfer belt 31 and is conveyed through the respective image forming stations, whereby the toner images of respectively colors formed on the photosensitive drums are transferred in succession. After such transfer step, the transfer paper P is separated from the transfer belt 31 and is conveyed to the fixing apparatus 5 by a conveyor belt 62 constituting recording material guide means.

Figure 9:
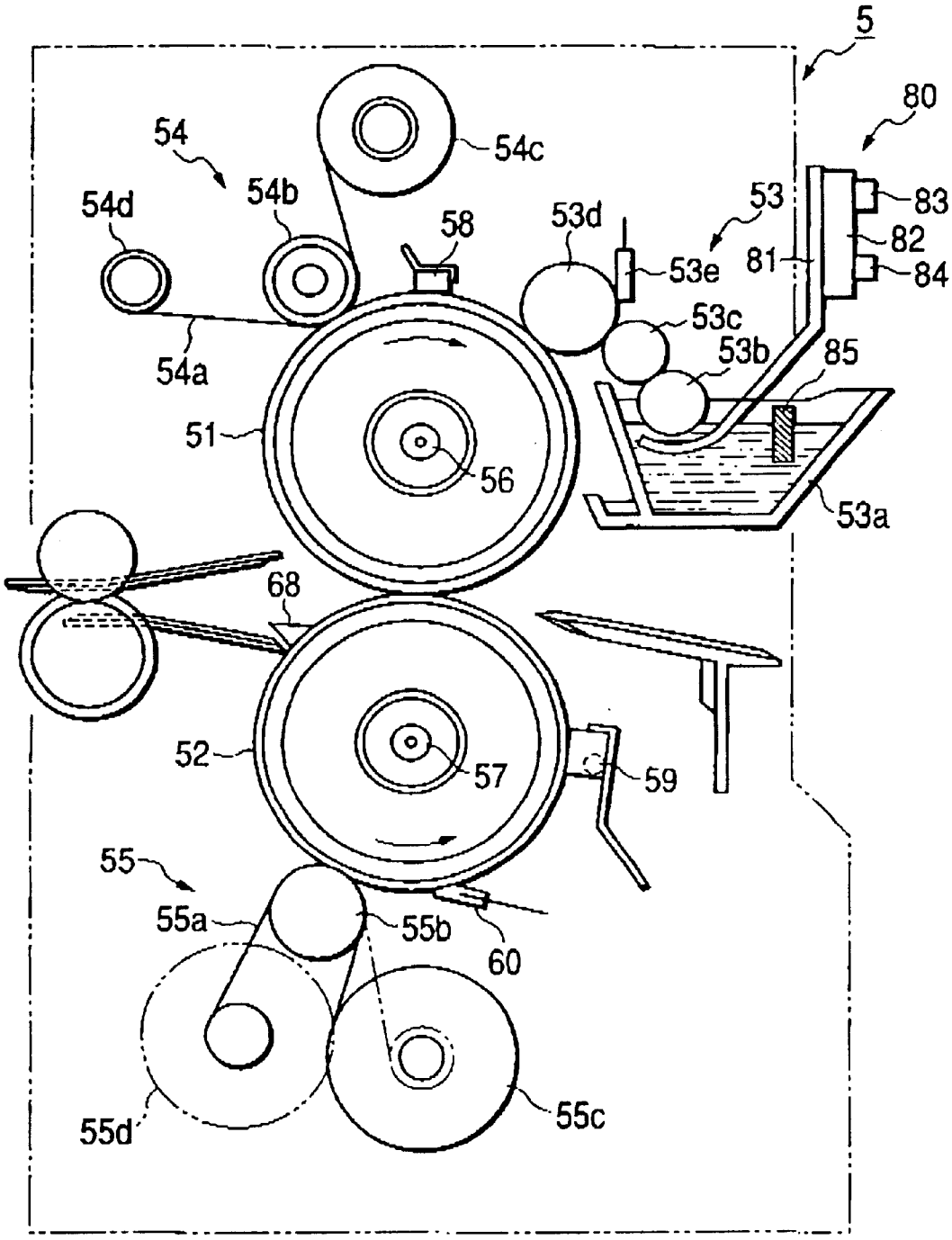
FIG. 9 is a view showing the fixing apparatus.

As detailedly shown in FIG. 9, the fixing apparatus 5 is provided with a fixing roller 51 constituting a rotatably provided fixing member, a pressure roller 52 constituting a pressurizing member which is rotatable in contact with the fixing roller 51, a releasing agent applying (coating) apparatus 53 constituting releasing agent supply/applying means, and roller cleaning apparatus 54, 55. The fixing roller 51 and the pressure roller 52 are respectively provided therein with heaters 56, 57 constituting heating means and composed for example of halogen lamps. Thermistors 58, 59 are so provided as to be in respective contact with the fixing roller 51 and the pressure roller 52, and the voltages to the heaters 56, 57 are controlled through a temperature adjusting circuit (not shown) to control the surface temperature of the fixing roller 51 and the pressure roller 52.

FIG. 9 is a schematic cross-sectional view showing the configuration of the fixing apparatus 5.

On the fixing roller 51, there are mounted a cleaning apparatus 54 and a releasing agent applying apparatus 53. The cleaning apparatus 54 removes the toner deposited by offsetting on the fixing roller 51, while the releasing agent applying apparatus 53 applies releasing agent such as silicone oil on the fixing roller 51, thereby facilitating separation of the transfer paper P from the fixing roller 51 and preventing the toner offsetting.

The cleaning apparatus 54 is composed of a cleaning web 54*a* consisting of a heat-resistant web-shaped non-woven cloth, a pressure roller 54*b* for pressing the cleaning web 54*a* to the fixing roller 51, an unwinding roller 54*c* for feeding the new cleaning web 54*a*, and a winding roller 54*d* for gradually winding the cleaning web 54*a* which is deteriorated in the cleaning ability for example by deposition of toner. The cleaning apparatus 54 is provided upstream of the thermistor 58 in the rotating direction of the fixing roller 51, in order to protect the thermistor 58 from detection error resulting from the sticking thereto of the offset toner.

When a predetermined number of copying operations is judged by a counter, a solenoid (not shown) is energized to activate a one-way clutch to wind the cleaning web 54*a* by a predetermined amount, in a direction opposite to the rotating direction of the roller. Such winding in the opposite direction avoids dragging of the cleaning web 54*a* in the rotating direction of the roller.

The releasing agent applying apparatus 53 is composed of an oil tank 53*a* or a releasing agent container for containing the releasing agent such as siliconee oil, an applying roller 53*d* constituting releasing agent supply means which bears the releasing agent or oil, picked up by pickup rollers 53*b*, 53*c* from the oil tank 53*a*, for supply onto the surface of the fixing roller 51, and a releasing agent heating member 80 for heating the releasing agent in the oil tank 53*a*, and a regulating blade 53*e* of an elastic member is so provided as to abut on the applying (coating) roller 53*d* for maintaining a constant oil amount thereon, thereby attaining uniform oil applying onto the fixing roller 51. The releasing agent applying apparatus 53 is positioned downstream of the thermistor 58 in the rotating direction of the fixing roller 51.

Also the pressure roller 52 is provided with a cleaning apparatus 55 composed, similarly to the cleaning apparatus 54, of a cleaning web 55*a*, a pressure roller 55*b*, an unwinding roller 55*c* and a winding roller 55*d*, in order to remove the toner on the pressure roller 52 transferred from the fixing roller 51.

On the pressure roller 52, there abuts an oil removing blade 60 as an elastic member for removing the excessive releasing agent remaining on the pressure roller 52. Without such oil removing blade 60, the excessive releasing agent is accumulated in the nip of the fixing roller 51 and the pressure roller 52, eventually causing a stain on the recording material or failure in the entry into the nip in certain recording material such as a transparent laminate OHP film. The oil removing blade 60 is composed for example of silicone rubber or fluorinated rubber, and abuts on the pressure roller 52 with an appropriate amount of intrusion in the opposite or forward direction with respect to the rotating direction of the pressure roller 52.

When a transfer paper P is conveyed in such configuration, the fixing roller 51 and the pressure roller 52 are rotated and silicone oil as the releasing agent is applied on the surface of the fixing roller 51. Thus, while passing between the fixing roller 51 and the pressure roller 52, the transfer paper P is pressed and heated by substantially constant pressure and temperature from both surfaces, hereby the unfixed toner image on the paper is fused and fixed to form a full-color image thereon. The transfer paper P bearing the fixed image is separated by an under separation claw 68 from the pressure roller 52 and is discharged from the apparatus.

In the following there will be explained in detail the releasing agent applying apparatus of the present invention, with reference to FIGS. 10 and 11.

Figure 10:
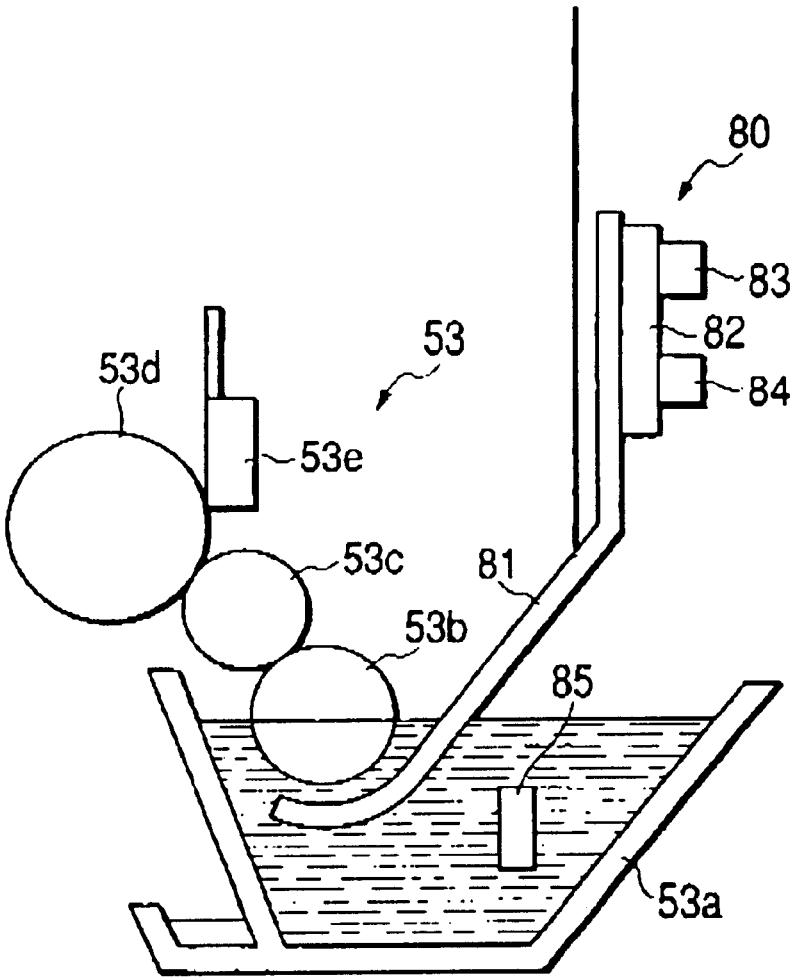
FIG. 10 is a view showing releasing agent applying means.
Figure 11:
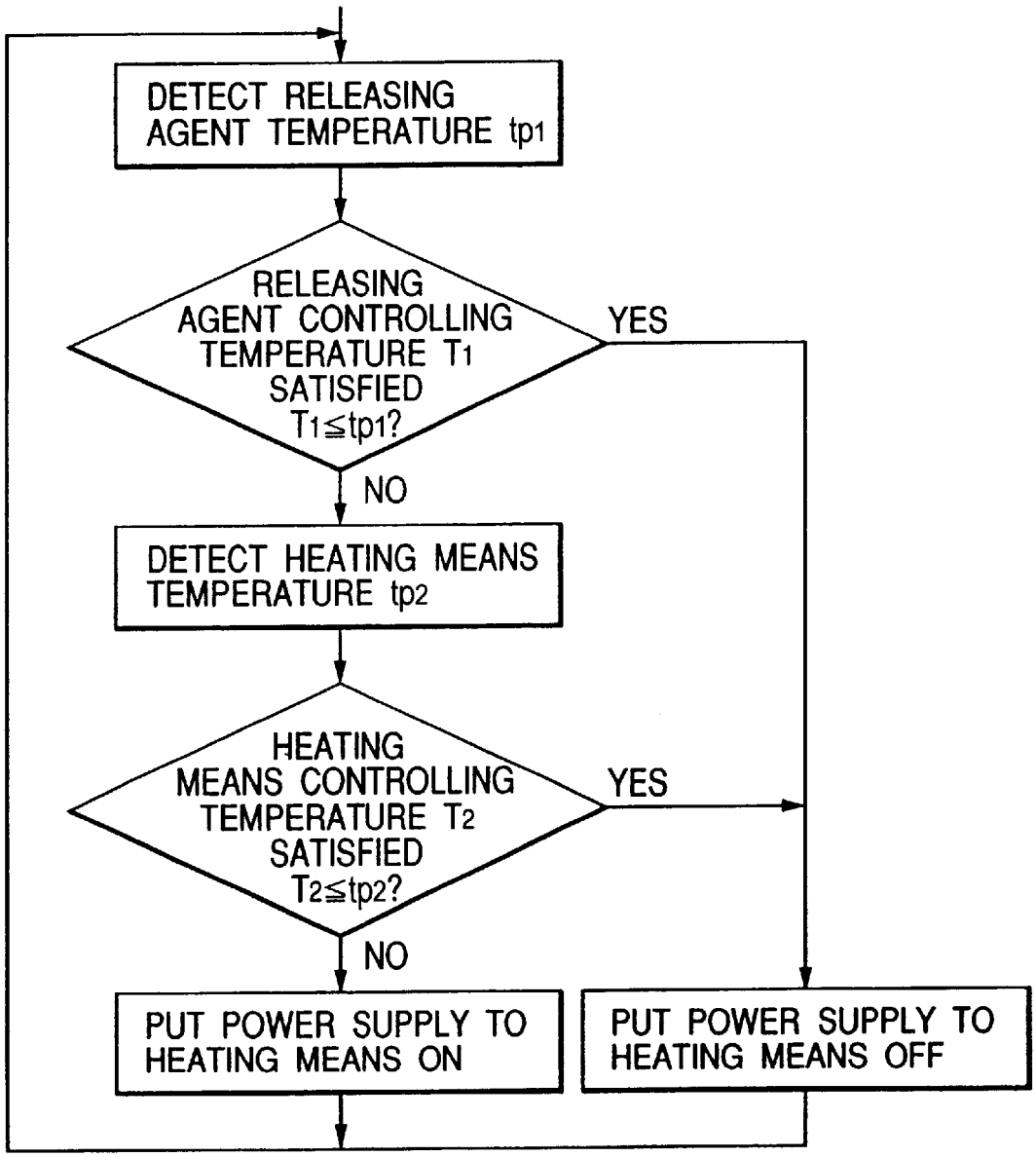
FIG. 11 is a flow chart showing the function of the releasing agent temperature control means.
Figure 12:
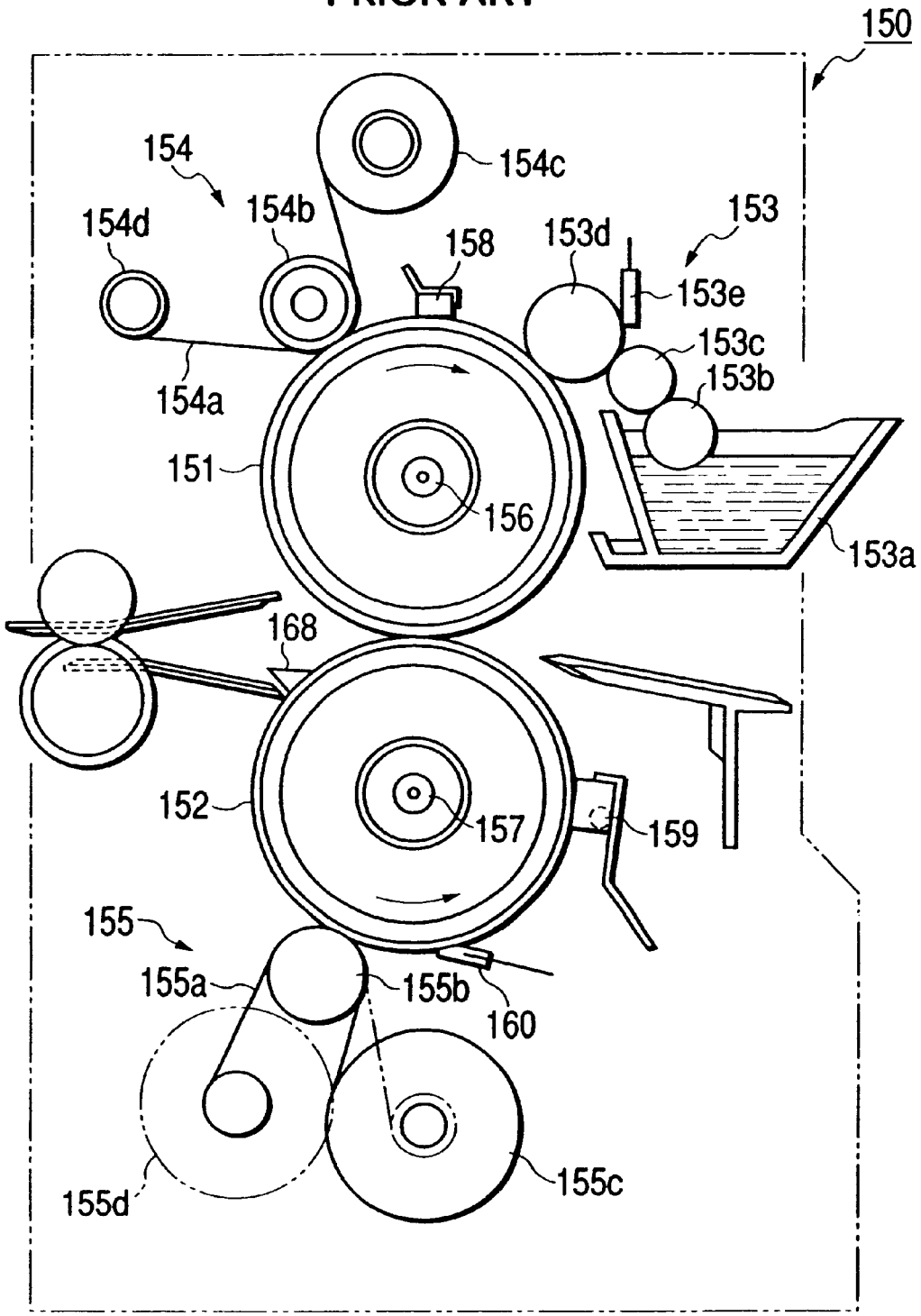
FIG. 12 PRIOR ART
FIGS. 12 and 13 are views showing conventional fixing apparatus.
Figure 13:
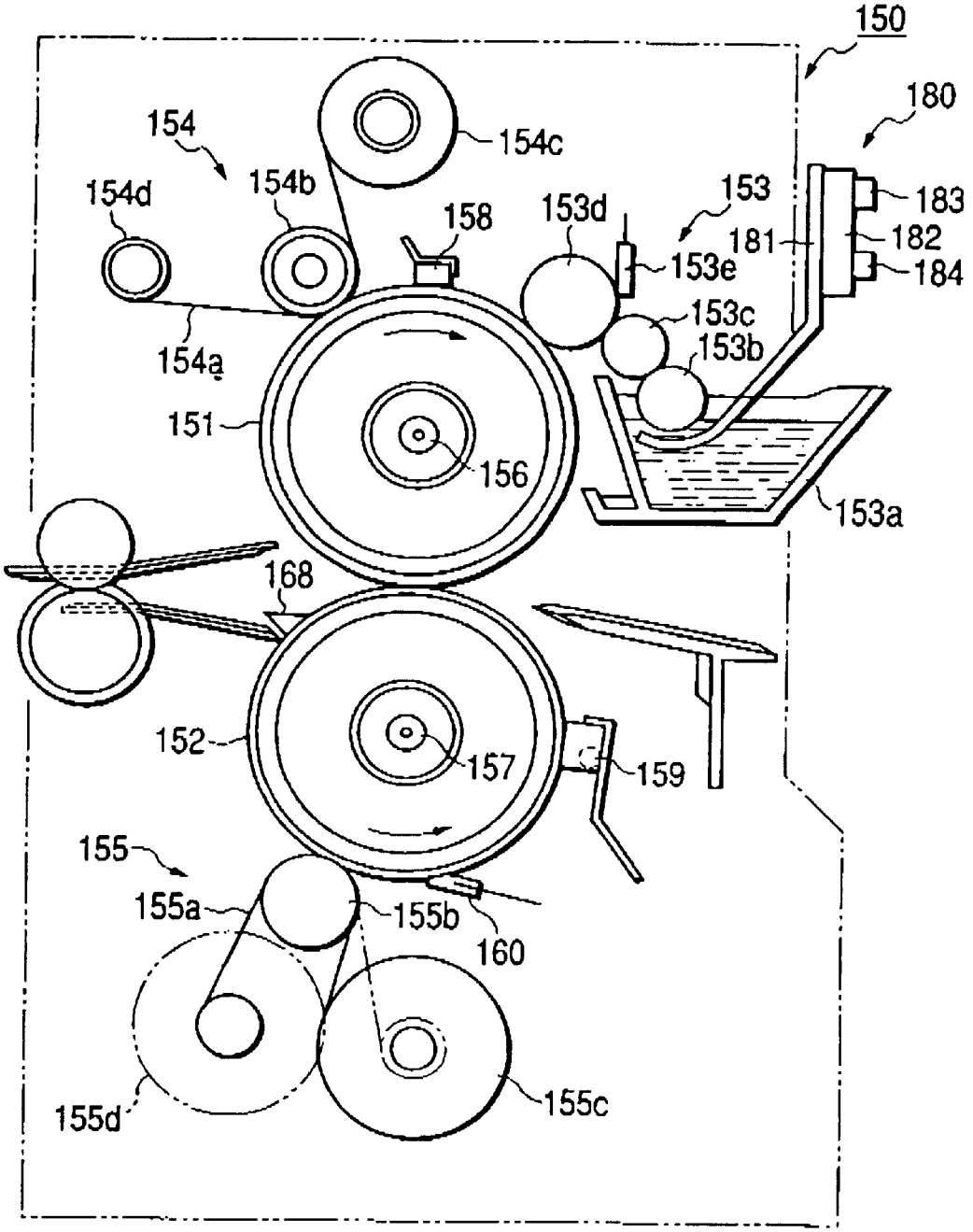

FIG. 10 is a schematic cross-sectional view showing the configuration of the releasing agent applying apparatus.

The releasing agent heating body 80, provided in the releasing agent applying apparatus 53 for heating the releasing agent in the oil tank 53*a*, is provided with a heater 82, composed of a planar heat generating member for generating heat under electric power supply and formed by covering a heat generating resistance body with an insulating body such as silicone rubber, and a heat conductive member 81 composed of a highly heat conductive metal plate mounted in contact with the heater 82 and partially immersed in the releasing agent in the oil tank 53*a*. The heat conductive member 81 is preferably composed of Al or Cu.

The releasing agent applying apparatus 53 is further provided with a heating body temperature detection means 83, a thermo switch 84 maintain in contact with the surface of a heater 82 of the releasing agent heating body 80 for preventing excessive temperature rise of the heater 82, releasing agent temperature detection means 85, releasing agent temperature control means and heating member temperature control means.

The heater 82 is controlled by the releasing agent temperature control means and the heating body temperature control means as will be explained later, in such a manner that, while the temperature of the heater 82 is maintained not exceeding the set temperature of the hating member based on the temperatures detected by the heating body temperature detection means 83 and the releasing agent temperature detection means, the oil temperature in the oil tank 53*a* is brought to the set temperature of the releasing agent.

In the following there will be explained the mode of heating of the releasing agent in the oil tank 53*a* by the releasing agent heating body 80, with reference to FIG. 11.

At first, the releasing agent temperature tp1 is detected by the releasing agent temperature detection means 85. If such detected releasing agent temperature is higher than the desired set temperature T1 of the releasing agent, the releasing agent temperature control means judges that the temperature of the releasing agent is high and turns off the electric power supply to the heater 82.

On the other hand, if the detected releasing agent temperature tp1 is lower than the set releasing agent temperature T1, the heating body temperature control means determines whether or not to execute electric power supply to the heater 82, based on the heating body temperature tp2 detected by the heating body temperature detection means 83 is higher or lower than the set heating body temperature T2.

If the heating body temperature tp2 detected by the heating body temperature detection means 83 is lower than the set heating body temperature T2, the electric power is supplied to the heater 82. In response the heat generating resistance body generates heat whereby the heater 82 starts temperature rise toward the set heating body temperature T2, thereby heating the releasing agent via the heat conductive member 81.

If the heating body temperature tp2 detected by the heating body temperature T2, even if the detected releasing agent temperature tp1 is low, the heating body temperature control means turns off the electric power supply to the heater 82, thereby not heating the releasing agent. The above-explained control is repeated at a predetermined interval.

Thus, even in case the detected releasing agent temperature tp1 is lower than the set releasing agent temperature T1, the heater 82 is not powered if the detecting heating body temperature tp2, indicating the temperature of the heater 82, is higher than the set heating body temperature T2.

In the present embodiment, as explained in the foregoing, the control of the heating body by the heating body temperature control means based on the result of detection by the heating body temperature detection means is given priority in comparison with the control of the releasing agent heating body by the releasing agent temperature control means based on the temperature detected by the releasing agent temperature detection means, so that the releasing agent can be safely heated without exceeding the desired temperature, by selecting a safe temperature value as the set heating body temperature of the releasing agent heating body.

The present invention has been explained by embodiments thereof, but the present invention is by no means limited to such embodiments and is subject to various modifications within the scope and spirit of the appended claims.

What is claimed is:

1. A fixing apparatus comprising:

a fixing member for heat fixing an unfixed image on a recording material;

a fixing heater for heating said fixing member;

a containing portion for containing releasing agent;

applying means for applying the releasing agent in said containing portion on said fixing member;

releasing agent heating means for contacting the releasing agent and heating the releasing agent;

detection means for detecting a temperature of the releasing agent in said containing portion; and heat control means for controlling the heating of the releasing agent effected by said releasing agent heating means, on the basis of a detected temperature of said detecting means.

2. A fixing apparatus according to claim 1, wherein said releasing agent heating means includes a heating body provided with a heat generating body, and a heat conduction member for transmitting a heat of said heating body to the releasing agent.

3. A fixing apparatus according to claim 1, further comprising another fixing member for forming a nip with said fixing member, wherein the recording material bearing the unfixed image is pinched and conveyed by said nip whereby the unfixed image is fixed onto the recording material.

4. A fixing apparatus comprising:

a fixing member for fixing an unfixed image on a recording material;

a containing portion for containing releasing agent;

applying means for applying the releasing agent in said containing portion on said fixing member;

heating means for heating the releasing agent in said containing portion;

first detection means for detecting a temperature of the releasing agent in said containing portion; and second detection means for detecting a temperature of said heating means;

wherein heating by said heating means is controlled according to detected temperature from said first and second detection means.

5. A fixing apparatus according to claim 4, wherein the heating by said heating means is executed when the detected temperature from said first detection means is lower than a first predetermined temperature and the detected temperature from said second detection means is lower than a second predetermined temperature, but is not executed when the detected temperature from said first detection means is lower than said first predetermined temperature and the detected temperature from said second detection means is higher than said second predetermined temperature.

6. A fixing apparatus according to claim 4, wherein said heating means includes a heating body provided with a heat generating body and a heat conductive member for transmitting a heat of said heating body to the releasing agent, wherein said heat conductive member is separate from said first detection means.

7. A fixing apparatus according to claim 6, wherein said second detection means is provided in said heating body.

8. A fixing apparatus according to claim 4, further comprising another fixing member for forming a nip with said fixing member, wherein the recording material bearing the unfixed image is pinched and conveyed by said nip whereby the unfixed image is fixed onto the recording material.

* * * * *

UNITED STATES PATENT AND TRADEMARK OFFICE

CERTIFICATE OF CORRECTION

PATENT NO. : 6,408,159 B2
DATED : June 18, 2002
INVENTOR(S) : Jiro Ishizuka et al.

It is certified that error appears in the above-identified patent and that said Letters Patent is hereby corrected as shown below:

Title page,
Item [57], ABSTRACT,
Line 3, “as” should read -- has --.

Column 10,
Line 16, “respectively” should read -- respective --.

Signed and Sealed this

Nineteenth Day of November, 2002

*Attest:*

*Attesting Officer*

JAMES E. ROGAN
*Director of the United States Patent and Trademark Office*